United States Patent [19]

Raith et al.

[11] 4,018,019

[45] Apr. 19, 1977

[54] PANEL AND STRUCTURAL UNITS FOR WALL ASSEMBLIES

[75] Inventors: Richard L. Raith, Solon; Joseph A. Davenport, Middleburg Heights, both of Ohio

[73] Assignee: Hauserman, Inc., Cleveland, Ohio

[22] Filed: May 27, 1975

[21] Appl. No.: 581,115

Related U.S. Application Data

[60] Division of Ser. No. 498,418, Aug. 19, 1974, Pat. No. 3,886,698, which is a continuation of Ser. No. 370,477, June 15, 1973, abandoned.

[52] U.S. Cl. ..... 52/239; 52/36; 248/243

[51] Int. Cl.[2] ..... A47B 5/02; A47G 19/02

[58] Field of Search ..... 52/496, 495, 239, 393, 52/40, 36, 281, 593, 238; 248/243; 211/191

[56] References Cited

UNITED STATES PATENTS 3,742,672 7/1973 Schaeufele ..... 52/588

3,759,297 9/1973 Anderson ..... 248/243

*Primary Examiner*—John E. Murtagh

*Attorney, Agent, or Firm*—Donnelly, Maky, Renner & Otto

[57] ABSTRACT

A sheet metal face for a structural panel has at least one edge portion bent and folded to define a recessed double-thickness flange. A plurality of longitudinally-spaced slots in the flange are used for attaching mounting members having upwardly facing hooking projections receivable in a hook pocket integral with a wall-hanging structural unit. A non-metallic protector strip may be interposed between the hooking projections and hook pocket. The structural unit has bottom and rear sheet metal panels with an integral assembly flange and assembly hook. A load bar assembly may be interposed between the mounting members and the structural unit.

18 Claims, 12 Drawing Figures

PANEL AND STRUCTURAL UNITS FOR WALL ASSEMBLIES

This is a division of application Ser. No. 498,418, filed Aug. 19, 1974, now U.S. Pat. No. 3,886,698; which is a continuation of Ser. No. 370,477, filed June 15, 1973, now abandoned.

BACKGROUND OF THE INVENTION

This application pertains to the art of wall assemblies, and more particularly to assemblies of the type wherein modular structural units are hung on walls assembled from a plurality of panels.

In previous assemblies of the type described, separate heavy gauge vertical posts are required between the panels for hanging structural units. The need for heavy structural posts makes the assembly more expensive.

Previous assemblies of the type described often have the mounting member slots visible and this presents an unsightly appearance.

Previous assemblies of the type described have also used structural units having complicated hanging arrangements for hanging the structural units to the mounting members.

SUMMARY OF THE INVENTION

An assembly of the type described includes substantially rectangular panels formed of spaced-apart light gauge sheet metal faces. The sheet metal faces are bent, folded and overlapped at their opposite edges to define reinforcing and mounting panel edges. With such an arrangement, heavy gauge structural posts are not required and longitudinally-spaced mounting member slots can be provided directly in the panel edges.

In accordance of another aspect of the invention, a pair of panels are positioned with mounting edges thereon facing one another in spaced-apart relationship. A relatively light gauge structural post is positioned between the panel mounting edges. Elastomeric gasket members are positioned between the post and the panel mounting edges, and include gasket flanges overlying the longitudinally-spaced slots. The gaskets also provide a sound barrier to seal the joints between adjacent panels.

In accordance with another aspect of the invention, a structural unit for hanging to the wall assembly includes a rear sheet metal panel having opposite side flanges bent rearwardly to define securing flanges. The upper edge of the rear panel is bent rearwardly in the same direction as the securing flanges to form an integral mounting hook. Side walls are secured to the securing flanges and a bottom panel is secured to the side walls. In a preferred arrangement, the bottom edge of the rear panel is bent rearwardly in the same direction as the mounting hook and securing flanges to define an assembly flange. The bottom panel has a rear edge reversely bent to form an assembly hook. The assembly flange and assembly hook are interdigitated for locking the bottom panel to the rear panel.

In accordance with another aspect of the invention, an elongated protector strip is positioned between the mounting members and the mounting hook on a structural unit for protecting the panel outer surfaces against damage by the mounting hook.

In accordance with another aspect of the invention, a load bar assembly is provided for hanging onto the mounting members and supporting smaller structural units which do not extend completely across a panel.

The load bar assembly also distributes the load from the smaller structural units and transfers the load to the panel edges. The load bar has opposite longitudinal edges bent into load bar hooks. Both longitudinal edges of the load bar assembly have substantially the same cross-sectional configuration so that the load bar assembly may be hung from the mounting members in either of two reversed positions.

In accordance with still another aspect of the invention, improved mounting members are provided for attachment to the panel edges to hang structural units thereon. The mounting members include a mounting flange having longitudinally-spaced locking tabs receivable in the slots in the panel edges. The mounting member includes a web extending laterally from the mounting flange. The mounting member web has a spacer flange extending outwardly therefrom in the same direction as the mounting flange. With the locking tabs received in the slots, the spacer flange engages a side portion of the panel outer surface to locate the web in outwardly-spaced substantially parallel relationship to a side edge portion of the panel outer surface. The mounting member has upper hooking means for reception in a mounting hook pocket on the structural units.

It is a principal object of the present invention to provide an improved structural panel having integral strengthened panel edges.

It is also an object of the present invention to provide an improved arrangement for connecting adjacent panel edges.

It is a further object of the present invention to provide improved wall-hanging structural units.

It is an additional object of the present invention to provide improved mounting members for hanging structural units to wall assemblies.

It is another object of the present invention to provide an improved load bar assembly for hanging relatively narrow structural units to wall assemblies and distributing the load of the structural units.

BRIEF DESCRIPTION OF THE DRAWINGS

The invention may take part of certain parts and arrangements of parts, preferred embodiments of which will be described in detail in this specification and illustrated in the accompanying drawings which form a part hereof.

DESCRIPTION OF THE PREFERRED EMBODIMENTS

Figure 1:
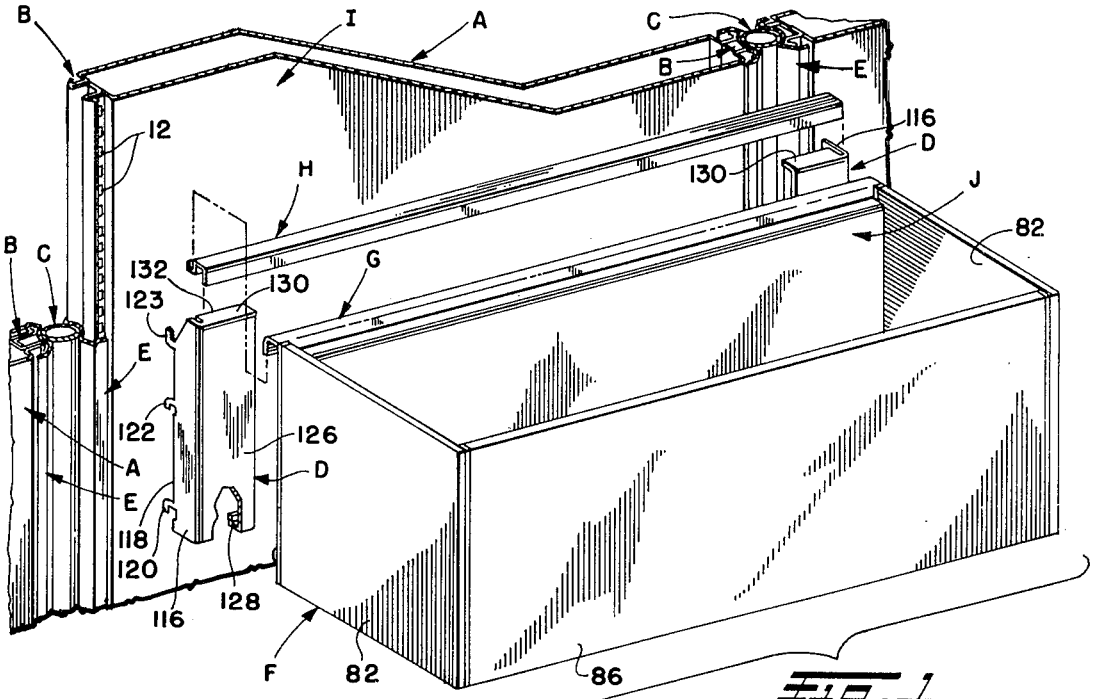
FIG. 1 is an exploded perspective illustration of a wall assembly and structural unit constructed in accordance with the present invention.

Referring now to the drawings, wherein the showings are for purposes of illustrating preferred embodiments of the invention only and not for purposes of limiting same, FIG. 1 shows a substantially vertical wall assembly constructed from a plurality of vertically-positioned generally rectangular panels A. Panels A have opposite side edges B which also define panel mounting edges. Vertical cylindrical posts C are positioned between panel edges B on adjacent panels for holding adjacent panels A together and in a substantially vertical position.

In one arrangement, panel edges B have longitudinally-spaced vertically-elongated slots 12 therein for attaching mounting members D to panel edges B. Vertically-elongated elastomeric gasket members E are positioned between posts C and panel edges B. Gaskets E include gasket flange portions overlying slots 12. A structural unit F has an upper rear mounting hook G engageable over the upper portions of mounting members D for hanging structural unit F on panel A. Structural unit F may take many different forms, such as an open-topped box, a shelf, a cabinet, or a drawer unit. The structural unit may also be defined by chalk board or bulletin board.

In a preferred arrangement, an elongated non-metallic protector strip H is positioned between the upper portions of mounting members D and structural unit mounting hook G for protecting the outer surfaces of panels A against damage.

Figure 10:
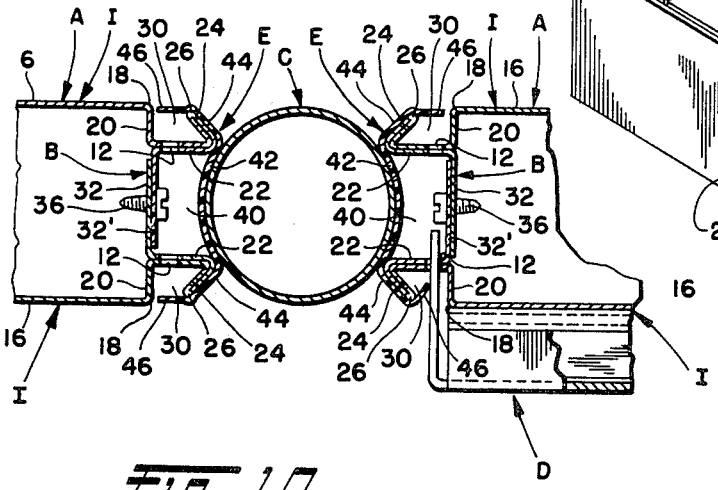
FIG. 10 is a cross-sectional elevational view showing a joint between adjacent panels.

With reference to FIG. 10, panel edge portions B are shown positioned in spaced-apart facing relationship with cylindrical posts C interposed therebetween. Each of panels A is constructed from a pair of substantially parallel spaced-apart light gauge sheet metal faces I have substantially rectangular plain central portions 16 and opposite edge portions 18. The space between central portions 16 of faces I may be filled with a honeycomb structure or any other suitable filling material. Each edge portion 18 of faces I is bent inwardly as at 20 to define a web portion extending the full length of metal sheets I. Web portions 20 extend substantially perpendicular to central portions 16 of faces I. End portions 18 are bent outwardly from webs 20 and reversely folded to define a main folded portion 22 and a terminal folded portion 24. Main folded portion 22 extends outwardly from web 20 substantially perpendicular thereto. Terminal folded portion 24 extends outwardly from main folded portion 22 and is inclined back toward web 20. Terminal folded portions 24 terminate at terminal folded portion edges 26 which are spaced outwardly from webs 20 to define mounting spaces 30. Longitudinally-spaced slots 12 are formed through main folded portions 22 and are in alignment with mounting spaces 30. The edge portions of metal sheets I are bent outwardly and then back to form main and terminal folded portions 22 and 24, and are then bent inwardly to define terminal flanges 32 and 32'.

Terminal flanges 32 extend in alignment with webs 20, while terminal flanges 32' are offset from webs 20 by an amount substantially equal to the thickness of flanges 32 or 32'. Flanges 32 and 32' can then be overlapped and secured together. Webs 20 and flanges 32 will be in alignment with one another. The offset of flange 32' will also allow terminal end edges 26 of terminal folded portions 24 to lie in a common vertical plane extending perpendicular to panels A. Each face I has a flange 32 along one side edge thereof, and a flange 32' along the opposite side edge thereof.

With the arrangement described, a pair of faces I having the bent and folded end configuration described are reversely positioned with central portions 16 thereof spaced apart, and with terminal flanges 32 and 32' thereof overlapping one another. Overlapping terminal flanges 32 and 32' are then secured together as by a plurality of longitudinally-spaced sheet metal screws 36. Obviously, overlapping terminal flanges 32 could also be secured together by other fasteners, such as rivets, or welded together.

The described bending and folding of sheet metal faces I, and their manner of securement together, provides opposite panel edges B with a generally channel-shaped cross-sectional configuration. The channel-shaped cross-sectional configuration includes spaced-apart longitudinally extending channel legs defined by main folded portions 22 and a channel base defined by overlapping terminal flanges 32. With such an arrangement, opposite panel edges B are very strong and capable of serving as structural supporting members themselves. This makes it unnecessary to provide a heavy gauge post C. This also eliminates the need for securing additional heavy gauge channels or the like to the opposite edges of panels A. With the arrangement described, outwardly opening channel spaces 40 are defined between main folded portions 22 on each panel edge B. At least a portion of post C extends into channel spaces 40 between main folded portions 22 for preventing lateral displacement of panels A relative to posts C.

In accordance with a preferred arrangement, elastomeric gasket members E are positioned between post C and panel edges B. Gaskets E may be formed of natural or neoprene rubber, or any suitable synthetic plastic material, such as polyvinylchloride compounded to be relatively soft and flexible. Gaskets E preferably extend the full length of panel edges B. Gaskets E include a central arcuate portion 42 spanning channel spaces 40. Gaskets E have inclined flange portions 44 overlying terminal folded portions 24. Gaskets E have terminal gasket flanges 46 which extend over terminal ends 26 of terminal folded portions 24 and substantially span across mounting spaces 30 toward webs 20 for overlying and concealing slots 12 in main folded portions 22. Gaskets E may be compounded in any desirable color for complementing the decorative surface color provided on metal sheets I and posts C.

Any one of terminal gasket flanges 46 may be deformed outwardly or inwardly for attaching a mounting member D to a panel edge B. Mounting members D may be positioned on either or both sides of panels A. Gaskets E provide a decorative covering which hides vertical slots 12 and presents a pleasing appearance. Gaskets E also provide a sound barrier to prevent or minimize transmission of sound from one side of panels A to the other through the joint portions therebetween.

Figure 3:
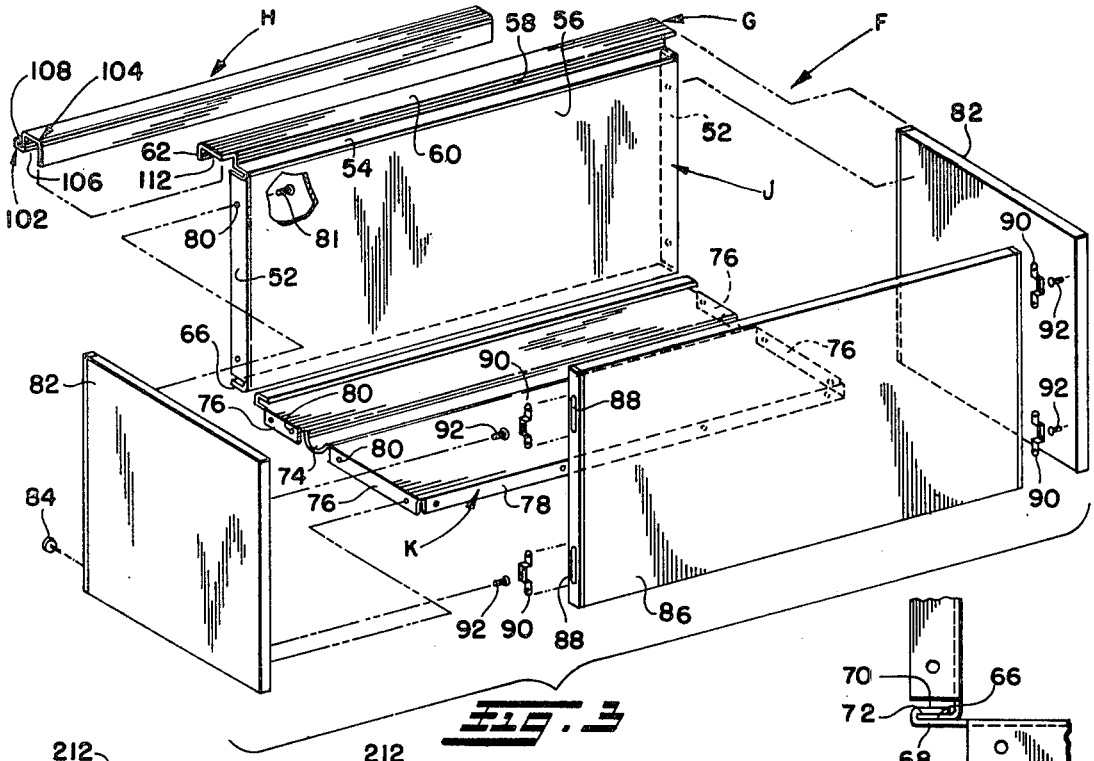
FIG. 3 is an exploded perspective illustration showing a structural unit constructed in accordance with the present invention.

With reference to FIG. 3, one arrangement for structural unit F is shown. Structural unit F is specifically shown as an open-top file box or the like. However, it will be recognized that the structural unit may also be formed as a shelf or cabinet unit having an open front, or having doors at the front or top. Structural unit F includes a substantially rectangular metal rear panel J having opposite side edges bent rearwardly to define securing flanges 52. The upper edge portion of rear panel J is bent to form mounting hook G. The upper edge of rear panel J is first bent rearwardly to form a first mounting hook flange portion 54 extending rearwardly from panel J in the same direction as securing flanges 52 and having substantially the same width as securing flanges 52. Securing flanges 52 and mounting hook flange 54 extend substantially perpendicular to plain rectangular main portion 56 of rear panel J. The upper edge of rear panel J is then bent upwardly to form a second hook flange 58 extending substantially perpendicular to first mounting hook flange 54. The upper edge of rear panel J is then bent rearwardly again to define a third mounting hook flange 60 extending substantially parallel to first mounting hook flange 54 and spaced above first mounting hook flange 54. The upper edge portion of rear panel J is then bent downwardly from third mounting hook flanges 60 to define a mounting hook terminal flange 62 extending downwardly from third flange 60 and extending substantially parallel to second mounting hook flange 58. Mounting hook G preferably extends substantially the full length of rear panel J. The bottom portion of rear panel J is bent rearwardly in the same direction as securing flanges 52 to define an assembly flange 66 extending substantially the full length of panel J.

Figure 4:
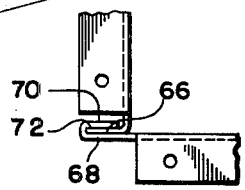
FIG. 4 is a partial end elevational view showing a joint used in the structural unit of FIG. 3.

A bottom substantially rectangular sheet metal panel K is provided for structural unit F. The rear edge portion of bottom panel K is reversely bent to define an assembly hook having vertically-spaced assembly hook flanges 68 and 70 defining an assembly hook pocket 72 therebetween. As shown in FIG. 4, the assembly hook and assembly flange are interdigitated for securing bottom panel K to rear panel J. That is, assembly flange 66 is tightly received in assembly hook pocket 72 between assembly hook flanges 68 and 70 in the manner shown in FIG. 4.

Bottom panel K may be bent intermediate its front and rear edges to provide a longitudinally extending reinforcement rib 74 which stiffens panel K against deformation. Panel K has downwardly bent side edge securing flanges 76 extending substantially perpendicular to bottom panel K. Bottom panel K also has a downwardly bent front securing flange 78 extending substantially perpendicular to panel K. Securing flanges 52 and 76 have suitable longitudinally-spaced holes therethrough generally shown by numeral 80 for receiving screws 81 which are threaded into suitable holes in side walls 82. Side walls 82 may be formed of any suitable material, such as boards, plywood, particle board, or synthetic plastic material. The described arrangement securely attaches side walls 82 to rear panel J and bottom panel K. Resilient bumpers as at 84 in FIG. 3 may be attached to the rear vertical edges of side walls 82 for bearing against an outer surface of panel A when structural unit F is hung on mounting members D. Structural unit F may have a front wall defined by a substantially rectangular panel 86. The opposite side edges of panel 86 may have elongated recesses 88 formed therein for receiving bracket members 90. Screws or the like may be used for securing bracket members 90 within recesses 88, with the outer surfaces of brackets 90 substantially flush with the outer opposite side edges of panel 86. Screws, as at 92, may be threaded into the inside edge surfaces of side walls 82 and have enlarged heads receivable in keyhole slots in brackets 90 for securing front panel 86 to side walls 82. It is obvious that many known arrangements may be provided for securing front panel 86 to side walls 82. Front securing flange 78 on bottom panel K has a plurality of longitudinally-spaced holes therethrough for receiving screws which thread into the inside bottom portion of front panel 86.

In accordance with one arrangement, elongated nonmetallic protector strip H may be extruded of any suitable synthetic plastic material or the like compounded to be somewhat rigid. For example, strip H may be formed of polyvinylchloride compounded to be somewhat rigid. Protector strip H has a cross-sectional configuration defined by a pair of reversely positioned generally U-shaped portions 102 and 104. Inverted U-shaped portion 104 has a downwardly facing opening 106 and is substantially larger than U-shaped portion 102 which has an upwardly facing opening 108. Inverted U-shaped portion 104 is dimensioned for snug reception within downwardly facing hook pocket 112 in mounting hook G on rear panel J. That is, the outer surfaces of inverted U-shaped portion 104 on protector strip H are in snug engagement with the inner surfaces on mounting hook flanges 58, 60 and 62. Terminal mounting hook flange 62 is snugly received within elongated upwardly facing opening 108 on U-shaped portion 102. That is, the opposite inner surfaces in upwardly opening pocket 108 are in snug engagement with the opposite surfaces of terminal mounting hook 62. With such an arrangement, mounting and dismounting of structural unit F will result in only protector strip H contacting panels A so that the outer surfaces thereof will not be damaged or scratched.

In accordance with one arrangement, mounting members D may be constructed of relatively heavy gauge metal and include an elongated upright mounting flange 116 having an inner mounting flange edge 118. Inner mounting flange edge has a plurality of longitudinally-spaced mounting hook tabs 120, 122 and 123. Mounting hook tabs 120 and 122 have hooking portions extending generally downwardly, while mounting hook tab 123 has an outer hooking portion extending generally upwardly. Mounting member D includes a central web portion 126 extending substantially perpendicular to mounting flange 116. Web portion 126 has a spacer flange 128 extending inwardly from the lower edge thereof. In the arrangement described, it is obvious that main folded portions 22 are spaced inwardly from the outer surfaces of central portions 16 on sheet metal panels I. Uppermost mounting hook tab 123 is first positioned through one of slots 12. Mounting member D is then moved upwardly as far as it will go and its lower end is swung toward panel A until mounting hook tabs 120 and 122 extend through others of slots 12. With mounting hook tabs 123 upwardly in contact with a top edge of one of slots 12, mounting hook tabs 120 and 122 will just clear the bottom edges of other slots for reception therethrough. Mounting member D is then released and drops down slightly so that mounting hook tabs 120 and 122 are locked behind bottom edges of certain slots 12, while tab 123 is locked behind an upper edge of its slot 12.

Mounting flange 116 is dimensioned to have a width greater than spacer flange 128 so that when mounting member D is mounted to slots 12 in the manner described, spacer flange 128 will bear against a side outer surface portion of panel a with web portion 126 extending substantially parallel to the outer surface of panel A. Mounting members D have upper hooking portions for reception in mounting hook pocket 112 on a structural unit F. In one arrangement, the upper hooking portion is defined by hooking flange 130 extending inwardly from the upper edge of web portion 126 substantially perpendicular thereto. Hooking flange 130 has a width less than the width of spacer flange 128 so that terminal hooking flange edge 132 is spaced outwardly from the outer surface of panel A. Hooking flange edge 132 is spaced outwardly from the outer surface of panel A a distance which is just sufficient for receiving U-shaped portion 102 on protector strip H. That is, the opposite outer surfaces on U-shaped portion 102 are spaced-apart substantially the same distance or slightly less than the distance from mounting flange edge 132 to the outer surface of panel A when mounting members D are attached to panels A in the manner described. Structural units F may then be hung from mounting members D by use of integral mounting hooks G on structural units F. In the preferred arrangement, protector strip H is first mounted onto mounting hook G before structural unit F is hung onto mounting members D.

Figure 2A:
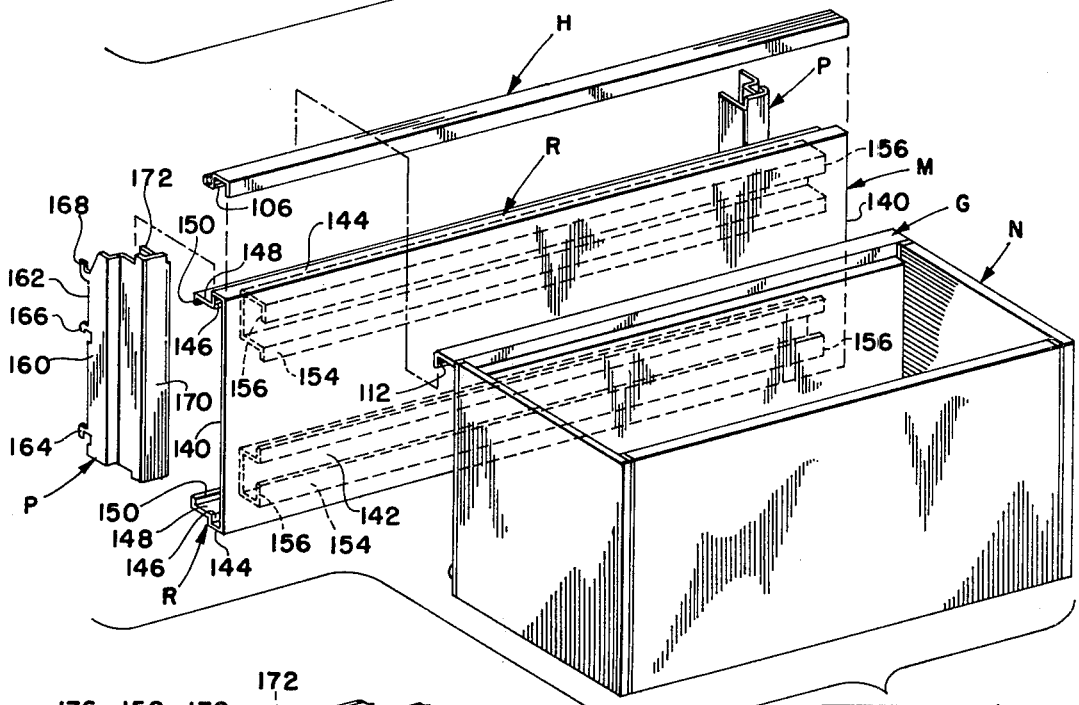
FIG. 2A is an exploded perspective illustration similar to FIG. 1 and showing a load bar assembly constructed in accordance with the present invention.

In accordance with another aspect of the invention, a load bar assembly M in FIG. 2A is provided for securing structural units N to a wall assembly of the same type described with respect to FIGS. 1 and 10. In this arrangement, mounting members P are provided. Load bar assembly M comprises a substantially rectangular sheet metal panel having opposite side edges 140 and spaced-apart longitudinal edges extending substantially perpendicular to side edges 140. Load bar assembly M includes a substantially rectangular central portion 142 having outer and inner surfaces. The opposite longitudinal edges of panel 142 are bent to have substantially the same cross-sectional configuration. The configurations at the opposite longitudinal edges are simply inverted relative to one another. The opposite longitudinal edges of load bar assembly M are bent to define load bar mounting hooks R. Each mounting hook R includes a first web 144 extending toward the inner surface of panel 142 substantially perpendicular to panel 142. A second web 146 extends downwardly from first web 144 in outwardly-spaced overlying relationship to the inner surface of panel 142 and substantially parallel to panel 142. A third web 148 extends outwardly from second web 146 substantially parallel to first web 144 and spaced inwardly therefrom. Load bar mounting hooks R terminate in terminal web 150 extending perpendicular to third web 148 and parallel to second web 146. Terminal web 150 is spaced outwardly from the inner surface of panel 142 in overlying relationship thereto.

With the arrangement described, load bar assembly M may be hung from mounting members P in either of two inverted positions. The load bar mounting hook R which is located along the bottom edge of load bar assembly M provides a spacer for engaging mounting members P and spacing panel 142 outwardly from the outer surface of a panel A in substantially parallel relationship thereto. A pair of spaced-apart elongated reinforcing metal beams 154 are spot welded to the inner surface of panel 142. Reinforcing beams 154 extend in a direction between opposite side edges 140 of panel 142. Reinforcing beams 154 have opposite ends 156 spaced inwardly from opposite side edges 140 by a distance generally the same as the total width of mounting members P.

Load bar assembly M may be hung on mounting members P when structural units N have a total width less than the distance between opposite panel edges B. Therefore, a plurality of relatively short structural units may be hung from load bar assembly M. Load bar assembly M will distribute the force or weight of the structural units and carry the load over to reinforced opposite panel edges B so that deformation of thin gauge sheet metal sheets I will not occur. Structural unit N may be assembled in the same manner as described with respect to structural F in FIG. 3, the only difference being that structural unit N has a width substantially less than the width of structural unit F. Structural unit N, or other structural units, may be in the form of shelves, drawers and cabinets for suspension on load bar assembly M.

Figure 2B:
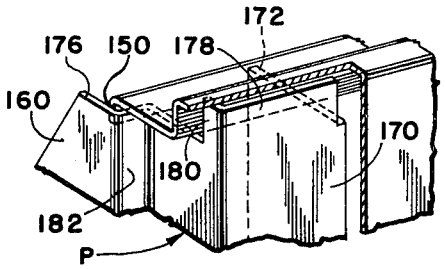
FIG. 2B is an enlarged perspective illustration showing how a mounting hook is positioned on a mounting member.

Mounting members P are adapted to be mounted on opposite panel edges B in the same manner as described with respect to mounting members D. Mounting members P include a mounting flange 160 having a mounting flange inner edge 162 with longitudinally-spaced tab hooks 164, 166 and 168 extending outwardly therefrom. Tab hooks 164, 166 and 169 correspond with tab hooks 120, 122 and 123 on mounting members D. Therefore, mounting members P are secured to panel edges B with the described tabs received in elongated slots 12 in the same manner as described with respect to mounting members D. Mounting members P have web portions 170 extending inwardly from mounting flange 160. A spacer flange 172 extends inwardly from the opposite edge of web portion 170. Like the arrangement described with respect to mounting members D, mounting flange 160 has a width greater than the width of spacer flange 172. With tabs 164, 166 and 168 received in slots 12, the inner edge of spacer flange 172 engages the outer side surface of panel A for spacing web portion 170 outwardly therefrom in parallel relationship thereto. The upper portion of mounting members P have upwardly facing hooking portions thereon for cooperation with load bar mounting hook R. Mounting flange 160 has a top edge 176, and web 170 has an upper hooking projection 178 extending upwardly above mounting flange top edge 176. Adjacent web portion 170, mounting flange 160 has a hooking projection 180 integral with projection 178 and extending substantially perpendicular thereto. In one arrangement, mounting flange 160 is deformed inwardly as at a perpendicular shoulder portion 182. Load bar mounting hook R is hung onto the top portion of mounting members P in the manner shown in FIG. 2B. The width of hooking projection 180, from an inner edge of hooking projection 180 to the outer surface of hooking projection 178, is substantially the same as the distance between the inner surface of second web 146 and the inner surface of panel 142. The distance from the inner edge of hooking projection 180 to the inner surface of shoulder 182 is substantially the same as the distance between the inner surface of second web 146 and the inner surface of terminal web 150. With mounting members P assembled to the wall assembly, the inner surface of shoulder 182 is spaced outwardly from the outer surface of panel A a sufficient distance that terminal web 150 on load bar mounting hook R can be received between the inner surface of shoulder 182 and the outer surface of panel A. The upper edge of spacer flange 172 is preferably cut-away a sufficient distance that terminal web 150 will not contact spacer flange 172. Protector strip H is assembled to mounting hook G on structural unit N in the manner previously described. The distance between the opposite inner surfaces of downwardly facing pocket 106 on protector strip H is substantially the same as the distance between the outer surface of panel 142 and the outer surface of second web 146. Therefore, strip H may be assembled to mounting hook G and then hooked over load bar mounting hook R. Protector strip H preferably has a length at least as great as the distance between opposite side edges 140 of panel 142. Structural units N may be hung in any desired position along load bar assembly M and may be shifted relative to load bar assembly M.

Figure 5:
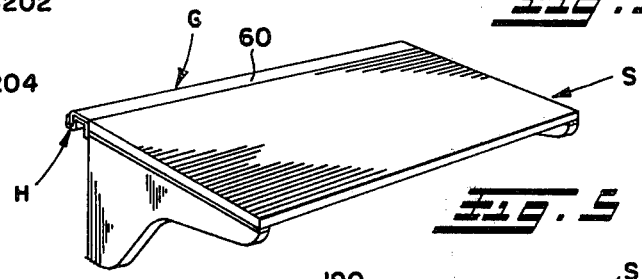
FIG. 5 is a perspective illustration of a shelf unit.
Figure 6:
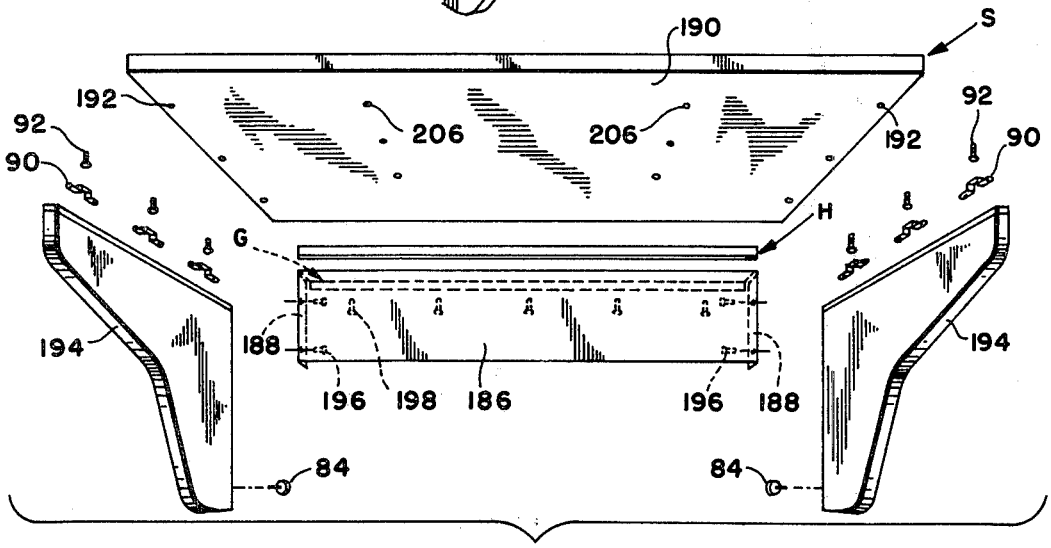
FIG. 6 is an exploded perspective illustration of the shelf unit of FIG. 5.

FIGS. 5 and 6 show a shelf unit S having a substantially rectangular sheet metal rear panel 186. Rear sheet metal panel 186 has opposite side edges bent rearwardly to form securing flanges 188. The upper edge portion of rear panel 186 is bent to form an integral mounting hook G in the same manner as described with respect to the mounting hook in FIG. 3. Protector strip H also cooperates with mounting hook G on panel 186 in the same manner as previously described. A rectangular top shelf board 190 has longitudinally-spaced holes in the bottom edge portions thereof as at 192 for receiving screws 92 having enlarged heads receivable in keyhole slots of brackets 90 which are secured within recesses in the upper edges of side boards 194 in the same manner as described with respect to recesses 88 in front panel 86 of FIG. 3. Securing flanges 188 have longitudinally-spaced holes therethrough for receiving screws 196 which are threaded into the inner rear edge portions of side boards 194. First flange 54 of mounting hook G may also have a plurality of longitudinally-spaced openings therethrough for receiving screws 198 which are threaded to the bottom rear portion of shelf board 190. The top surface of shelf board 190 will then be substantially flush with the top surface of second mounting hook flange 60. Shelf unit S is then hung to mounting members D, or onto load bar assembly M, in the same manner as described with respect to hanging structural units F and N.

Figure 7:
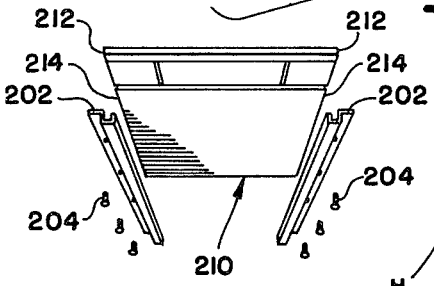
FIG. 7 is an exploded perspective illustration of a drawer unit and drawer slides useable with the shelf unit of FIG. 6.

A pair of spaced-apart drawer slide members 202 of FIG. 7 may be secured to the underside of shelf board 190 by screws 204 extending into longitudinally-spaced holes 206 in the bottom surface of shelf board 190. A drawer unit 210 may then have its opposite side edges 212 extending outwardly beyond its bottom opposite edges 214 for slidable reception on drawer slides 202. Various other arrangements for mounting drawers for hanging onto the wall assembly may also be used.

Figure 8:
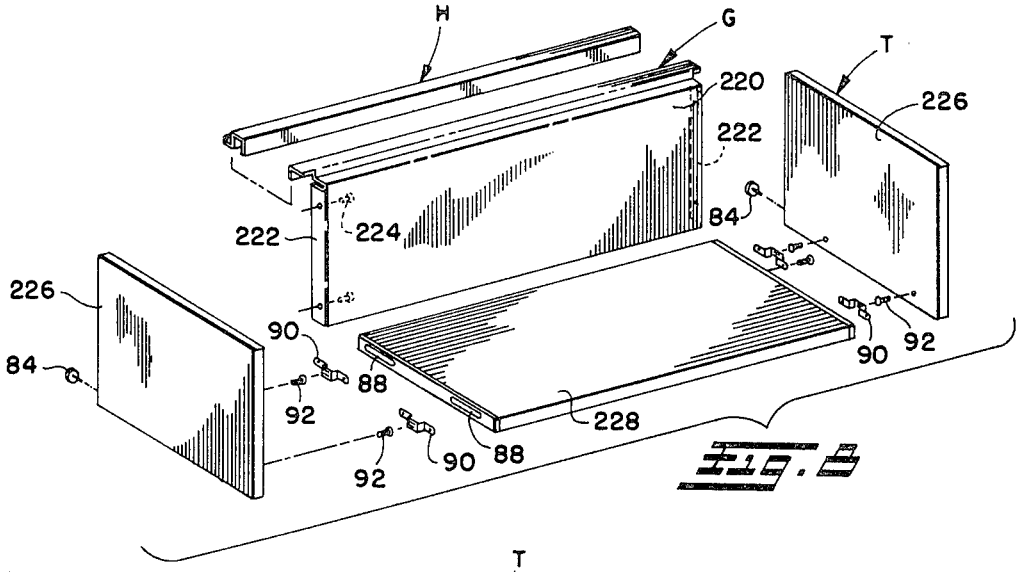
FIG. 8 is an exploded perspective illustration of a structural shelf unit.
Figure 9:
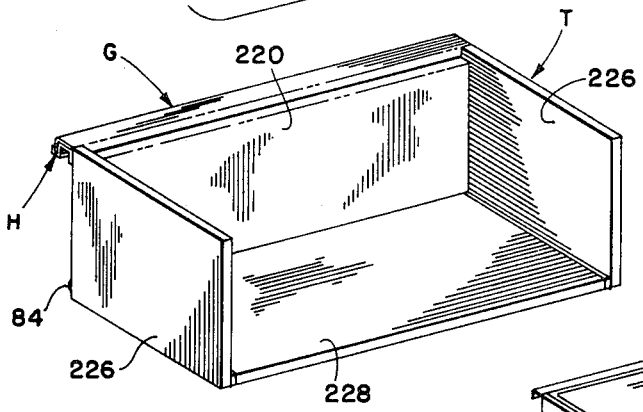
FIG. 9 is a perspective illustration of an assembled shelf unit shown in FIG. 8.

FIGS. 8 and 9 show another structural unit T. Structural unit T is substantially the same as structural unit F except for having a different bottom panel. Rear sheet metal panel 220 of structural unit T has opposite side edges bent rearwardly to define securing flanges 222. The upper edge portion of rear sheet metal panel 220 is bent in the same manner as described with respect to panel J of FIG. 3 to form an integral mounting hook G. Securing flanges 222 have longitudinally-spaced holes therethrough for receiving screws 224 which are threaded into the inner rear portions of sidewalls 226. A bottom panel board 228 has recesses 88 in the opposite side edges thereof for receiving mounting brackets 90 having keyhole slots therein for cooperation with enlarged heads on screws 92 attached to the inner surfaces of side walls 226 for mounting sidewalls 226 to bottom panel board 228.

Figure 11:
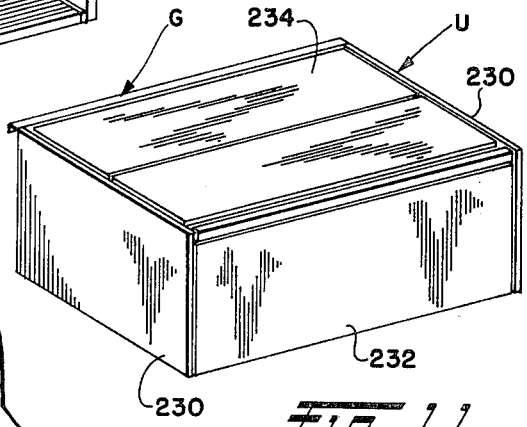
FIG. 11 is a perspective illustration of another structural unit.

FIG. 11 shows another unit U having a sheet metal rear panel bent to provide an integral mounting hook G in the same manner as previously described. Structural unit U has opposite side walls 230 and a front wall 232. A cover 234 may be hingedly connected with the rear upper portion of side walls 230 or with first flange 54 on mounting hook G. Obviously, various other types of structural units may also be provided. Each structural unit is common in that it includes a rear sheet metal panel having an integral mounting hook G formed thereon. Various types of shelves, cabinets, drawers and boxes may be provided for hanging onto the wall assembly in the manner described. Various other structural units, such as chalk boards or bulletin boards, may also be hung from the wall assembly in the same manner. In such arrangements, a small sheet metal panel having an integral mounting hook G thereon would be secured to the upper rear surface of the chalk board or bulletin board.

Although the invention has been shown and described with respect to certain preferred arrangements, it is obvious that equivalent alterations and modifications will occur to others skilled in the art upon the reading and understanding of this specification. The present invention includes all such equivalent alterations and modifications, and is limited only by the scope of the claims.

The embodiments of the invention in which an exclusive property or privilege is claimed are defined as follows:

1. A sheet metal face for a rectangular panel, said sheet metal face having at least one edge portion bent and folded to define a recessed double-thickness flange, a plurality of longitudinally spaced slots in said flange, said face having a substantially plane rectangular central portion and opposite side edge portions, both of said side edge portions being bent and folded to have said recessed double-thickness flange thereon, each of said edge portions being bent to define a web portion extending inwardly from said central portion, each of said edge portions being reversely folded to define a main folded portion extending outward from said web portion relative to said central portion, said main folded portion extending back toward said web portion and being bent to define an inwardly extending terminal flange which extends inward relative to said central portion in the same direction as said web portion, and said main folded portions defining said double-thickness flanges.

2. The sheet metal face of claim 1 wherein each of said main folded portions includes a terminal folded portion extending outward from said main folded portions in a direction opposite to said terminal flange.

3. The sheet metal face of claim 2 wherein said terminal folded portions are inclined to extend outwardly and back toward said web, said terminal folded portions having terminal folded portion ends spaced from said web portion to define mounting spaces, said openings in said main folded portions being aligned with said mounting spaces.

4. The sheet metal face of claim 3 wherein said web portion of terminal flanges are substantially in alignment with one another and extend substantially perpendicular to said central portion, said main folded portion being substantially parallel to said central portion.

5. The sheet metal face of claim 3 wherein a pair of said faces are reversely positioned with said central portions thereof in substantially parallel spaced-apart relationship with said terminal flanges thereon overlapping one another, and securing means for securing said overlapping terminal flanges together to define a substantially rectangular panel having panel edge portions of substantially channel-shaped cross-sectional configuration including outwardly opening channel spaces defined by spaced-apart legs formed by said main folded portions and a base formed by said overlapping terminal flanges.

6. The panel of claim 5 wherein each of said main folded portions includes a terminal folded portion extending outward from said main folded portions in a direction opposite to said terminal flange.

7. The panel of claim 6 wherein said terminal folded portions are inclined to extend outwardly and back toward said web, said terminal folded portions having terminal folded portion ends spaced from said web portions to define mounting spaces, said openings in said main folded portions being aligned with said mounting spaces.

8. The panel of claim 7 wherein said web portion of terminal flanges are substantially in alignment with one another and extend substantially perpendicular to said central portion, said main folded portion being substantially parallel to said central portion.

9. The panel of claim 5 wherein a pair of said panels are positioned substantially vertically in substantially aligned relationship with panel edge portions thereof in spaced-apart relationship to define a pair of panel mounting edge portions, a post member positioned between said pair of panel mounting edge portions, and said post member extending at least partially into said channel spaces between said legs to form a wall assembly from said post and said panels.

10. The wall assembly of claim 9 and further including elastomeric gasket members positioned between said post and said panel mounting edge portions, said gasket members having terminal gasket flanges extending over said main folded portions for concealing said openings in said main folded portions.

11. The wall assembly of claim 10 wherein each of said main folded portions includes a terminal folded portion extending outward from said main folded portions in a direction opposite to said terminal flanges, said terminal folded portions having terminal folded portion ends spaced from said web portions to define mounting spaces, said openings in said main folded portions being aligned with said mounting spaces, and said gasket flanges extending over said terminal folded portion ends across said mounting spaces toward said web portions.

12. The wall assembly of claim 11 wherein said terminal folded portions are inclined to extend back toward said web portions from said main folded portions.

13. A wall assembly comprising; a pair of substantially vertical panels having mounting panel edges facing one another in spaced-apart relationship, said mounting panel edges having channel-shaped cross-sectional configurations including outwardly opening channel spaces defined between spaced-apart channel legs and a channel base, a post positioned between said mounting panel edges, said post extending at least partially into said channel spaces between said channel legs, a plurality of longitudinally-spaced mounting openings in said channel legs, elastomeric gaskets positioned between said post and said mounting panel edges, said gasket having gasket flanges extending over said channel legs and substantially covering said openings.

14. The assembly of claim 13 wherein said post has a substantially cylindrical cross-sectional configuration.

15. The assembly of claim 13 wherein said panels are formed of spaced-apart metal sheets having side edge portions bent and folded to define said channel-shaped cross-sectional configuration of said mounting panel edges.

16. The assembly of claim 15 wherein said channel legs include main portions and terminal portions, said terminal portions extending outwardly from said main portions and being inclined in a direction away from said post, said gasket flanges extending over said terminal portions.

17. A substantially rectangular interior partition panel including spaced apart sheet metal faces having opposite vertical edge portions bent, folded and secured together to provide said panel, each sheet metal face having at least one vertical edge bent inwardly and then folded upon itself to define a double-thickness recessed vertical flange, the major extent of which extends parallel to and recessed from the face, and a vertical row of slots in the major extent of said double thickness recessed flange for the support of accessories on said panel.

18. A sheet metal face as set forth in claim 17 wherein the outer end of the double-thickness recessed flange is bent outwardly of the major extent thereof toward the plane of the face.

* * * * *